US007996932B2

(12) United States Patent
Elnar

(10) Patent No.: US 7,996,932 B2
(45) Date of Patent: Aug. 16, 2011

(54) SPA WALL MOUNTED WATER JET NECK AND SHOULDER MASSAGER

(76) Inventor: Joseph G. Elnar, Riverside, CA (US)

( * ) Notice: Subject to any disclaimer, the term of this patent is extended or adjusted under 35 U.S.C. 154(b) by 810 days.

(21) Appl. No.: 12/058,458

(22) Filed: Mar. 28, 2008

(65) Prior Publication Data

US 2009/0241255 A1 Oct. 1, 2009

(51) Int. Cl.
*A47K 3/10* (2006.01)

(52) U.S. Cl. ..... 4/541.6; 4/575.1

(58) Field of Classification Search ..... 4/575.1, 4/571.1, 541.3, 541.4, 541.6, 678, 567, 568, 4/570, 541.1
See application file for complete search history.

(56) References Cited

U.S. PATENT DOCUMENTS 4,334,328 A * 6/1982 Delepine ..... 4/678
4,635,619 A 1/1987 Diamond
4,839,930 A 6/1989 Watkins
4,886,210 A * 12/1989 Gaffney et al. ..... 239/193
5,101,521 A * 4/1992 Levien ..... 4/559
5,333,324 A 8/1994 Pinciaro
5,546,616 A 8/1996 Bloemer et al.
5,617,591 A * 4/1997 Bloemer et al. ..... 4/541.6
5,682,625 A 11/1997 Leaverton et al.
5,716,333 A 2/1998 Larsen
5,928,171 A 7/1999 Larsen
5,984,883 A * 11/1999 Elnar ..... 601/86
6,182,303 B1 2/2001 Gardenier et al.
6,186,964 B1 2/2001 Branham
6,502,253 B1 1/2003 Olney
6,578,774 B1 * 6/2003 Noyes ..... 239/17
7,200,879 B2 * 4/2007 Li et al. ..... 4/507
2002/0053105 A1 * 5/2002 Turner ..... 4/541.1
2002/0148038 A1 10/2002 Gardenier et al.
2003/0070218 A1 4/2003 Gardenier et al.
2006/0137089 A1 * 6/2006 Hatrick-Smith et al. ..... 4/567

* cited by examiner

*Primary Examiner* — David Purol
(74) *Attorney, Agent, or Firm* — Kenneth L. Green

(57) ABSTRACT

A spa wall mounted head rest directs a curved sheet of water against a user's neck and shoulders. The head rest is fed by two laterally spaced apart water flows and includes an internal manifold to uniformly direct the flows across a curved outlet. The resulting curved flow is uniformly directed against the user's neck and shoulders. The head rest has a curved back to allow mounting in a corner of the spa wall and includes an easily removable and replaceable head rest cover allowing easy maintenance.

8 Claims, 6 Drawing Sheets

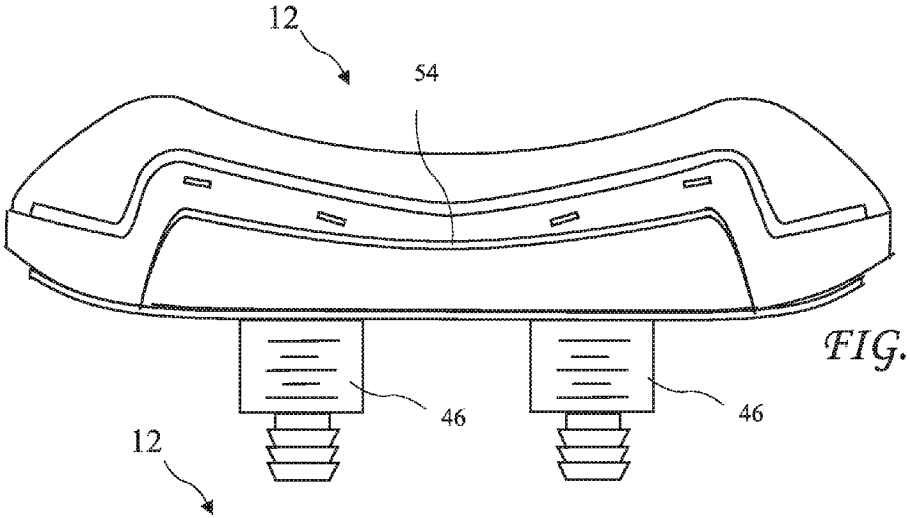
FIG. 10A
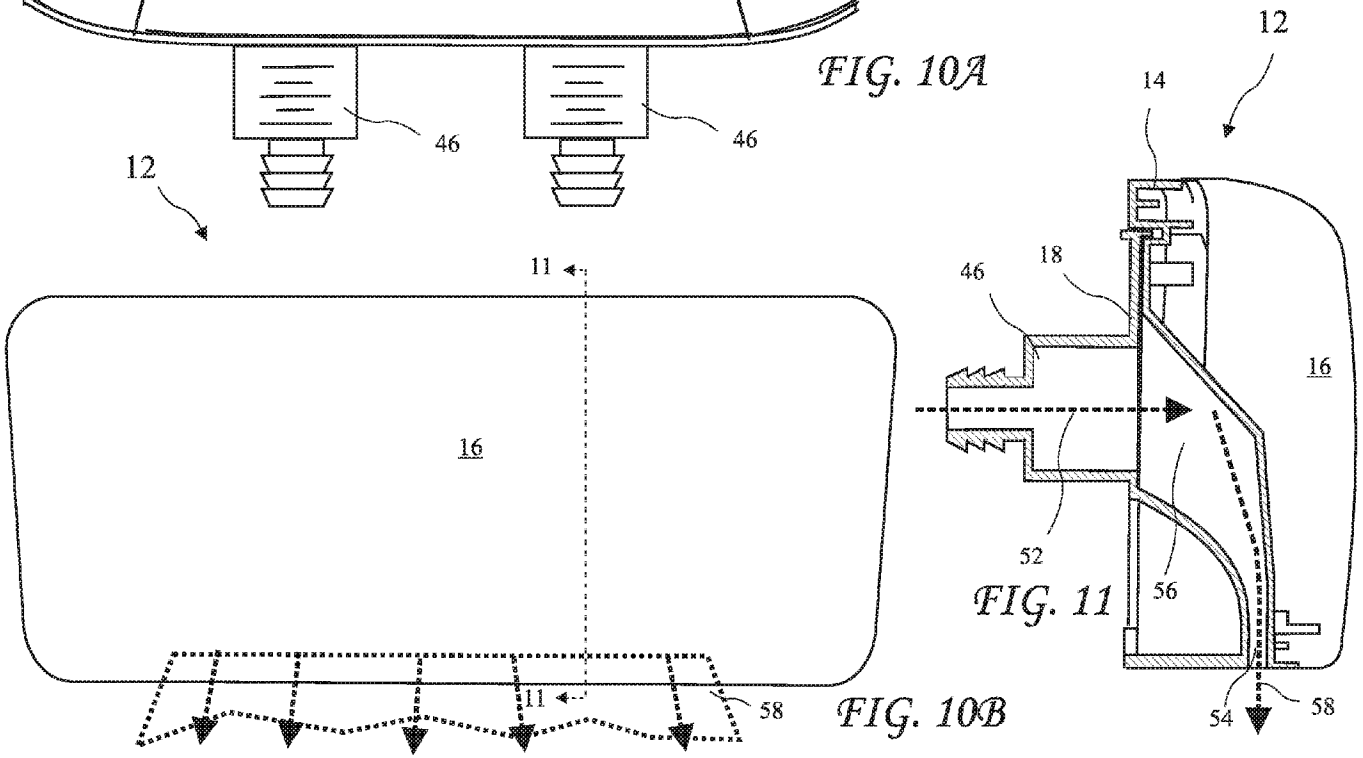
FIG. 10B
FIG. 11

SPA WALL MOUNTED WATER JET NECK AND SHOULDER MASSAGER

BACKGROUND OF THE INVENTION

The present invention relates to massagers and in particular to neck and shoulder massagers mounted to a spa wall.

Spas are commonly enjoyed by millions of users as a relief to the stress and tension of every day life. Water jets in spa walls provide a liquid massage to a user's back, sides, arms, and legs relaxing muscles and soothing joints. Unfortunately, the massages provided by the wall mounted jets do not address the significant tension often experienced in the neck area.

U.S. Pat. No. 6,182,303 for "Multiple Slot Fluid Flow", and US Patent Application Publication No. 2003/0070218 for "Head Rest Assembly Having an Illuminated Insert for a Spa," disclose head rests with straight slots for mounting on a flat spa wall for providing a flat sheet of water to massage a user's neck. Unfortunately, the internal manifolds of the '303 patent and '218 publication do not provide a uniform flow across the water sheet and centered feeds tend to concentrate the flows at the center of the water sheet. Further, such flat sheets of water merely graze a user's back, and often fail to address the areas experiencing tension and stress.

BRIEF SUMMARY OF THE INVENTION

The present invention addresses the above and other needs by providing a spa wall mounted head rest which directs a curved sheet of water against a user's neck and shoulders. The head rest is fed by two laterally spaced apart water flows and includes an internal manifold to uniformly direct the flows across a curved outlet. The resulting curved flow is uniformly directed against the user's neck and shoulders. The head rest has a curved back to allow mounting in a corner of the spa wall and includes an easily removable and replaceable head rest cover allowing easy maintenance.

In accordance with one aspect of the invention, there is provided a spa wall mounted head rest and neck and shoulder massager. The head rest and massager includes a headrest back plate, a headrest support plate, and a head rest cover. The headrest back plate resides in a corner of a spa and has a back plate rear face residing against the spa wall and a back plate front face opposite the back plate rear face. The back plate includes two laterally spaced apart water inlets on the back plate rear face for receiving two horizontal flows of water. A slanted floor surface of the back plate front face resides below the water inlets and faces upward and forward and extending laterally to at least the lateral separation of the two inlets. The headrest support plate resides against the back plate front face. A curved and slanted roof surface of the support plate vertically overlaps with the water inlets and faces down and towards the water inlets and including two peaks. Each peak laterally overlaps one of the two water inlets and the roof surface widens downward from each peak and joining between the peaks for directing the horizontal flows of water into a uniformly laterally distributed downward flow of water. A vertical wall surface of the support plate extends downward from a lower edge of the roof surface of the support plate and faces the back plate. A gap between the floor surface of the back plate and the roof surface and the wall surface of the support plate is in fluid communication with the water inlets and carries the downward flow of water. A downward facing laterally slotted water outlet resides between the back plate and the support plate and is curved away from the spa wall at ends of the slotted water outlet and is in fluid communication with the gap for receiving the downward flow of water and disbursing the downward flow of water as a sheet of water directed downward against a user's neck and shoulders. The head rest cover resides over the support plate.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 10A is a bottom view of the head rest and massager according to the present invention showing a laterally slotted curved water outlet according to the present invention.

FIG. 10B is a front view of the head rest and massager according to the present invention showing a sheet of water directed downward from the laterally slotted curved water outlet.

FIG. 11 is a cross-sectional view of the head rest and massager according to the present invention showing a horizontal flow of water into the head rest and massager and the sheet of water directed downward from the head rest and massager.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
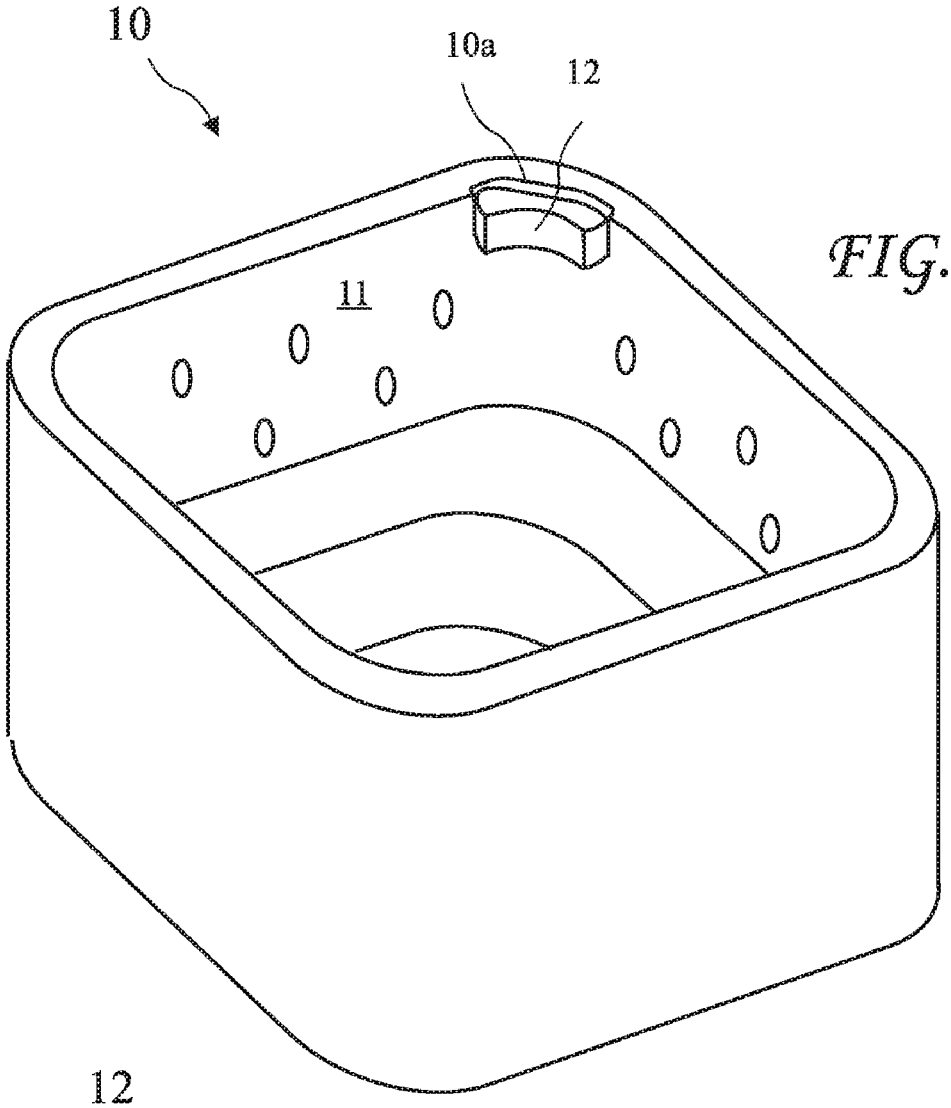
FIG. 1 is a spa with a head rest and massager according to the present invention residing in a corner of a wall of the spa.
Figure 2:
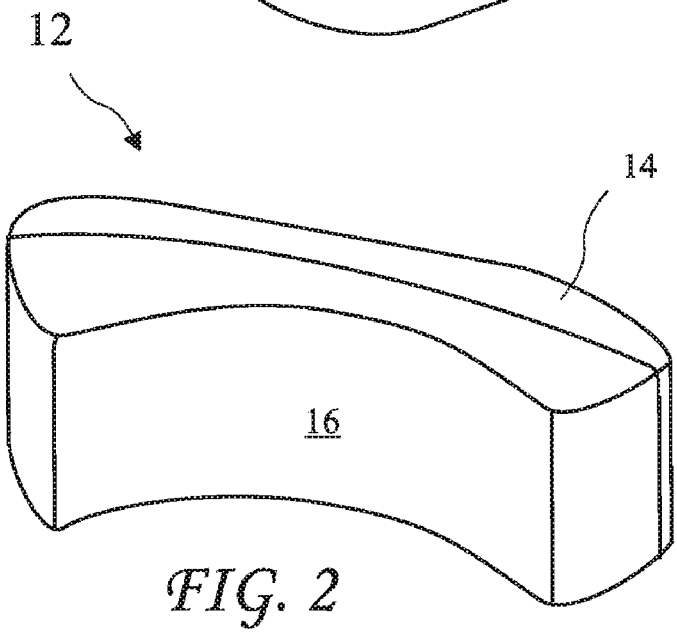
FIG. 2 is a detailed view of the head rest and massager according to the present invention.

A spa 10 with a head rest and massager 12 according to the present invention residing in a corner 10*a* of a wall 11 of the spa 10 is shown in FIG. 1 and a detailed view of the head rest and massager 12 is shown in FIG. 2.

Figure 3:
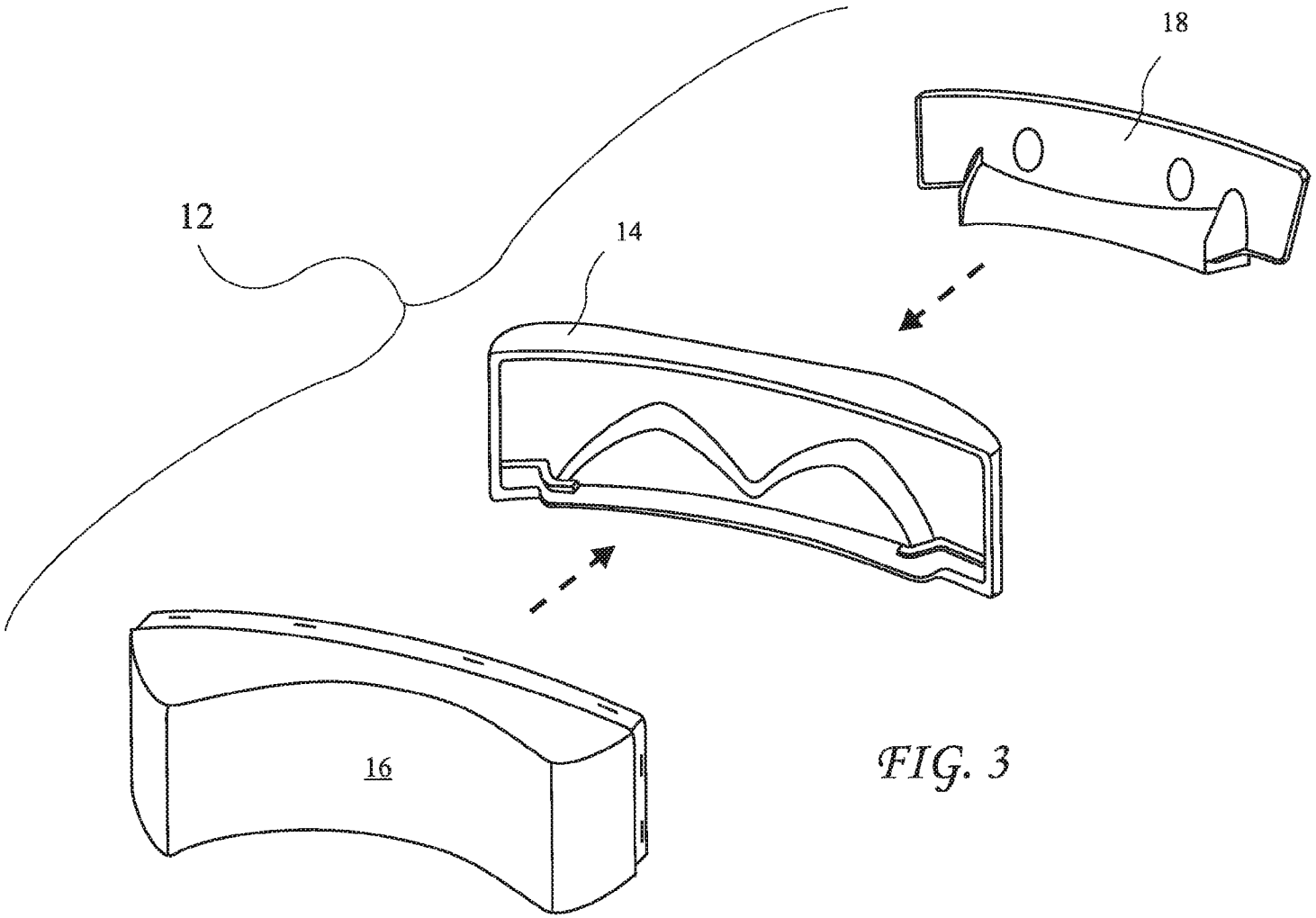
FIG. 3 is an exploded view of the head rest and massager according to the present invention.

An exploded view of the head rest and massager 12 according to the present invention is shown in FIG. 3. The head rest and massager 12 comprises three parts, a head rest cover 16, a head rest support plate 14, and a head rest back plate 18.

Figure 4A:
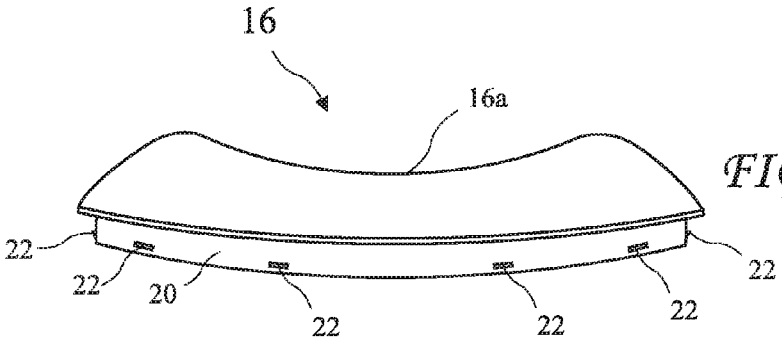
FIG. 4A is a top view of a head rest cover of the head rest and massager according to the present invention.
Figure 4B:
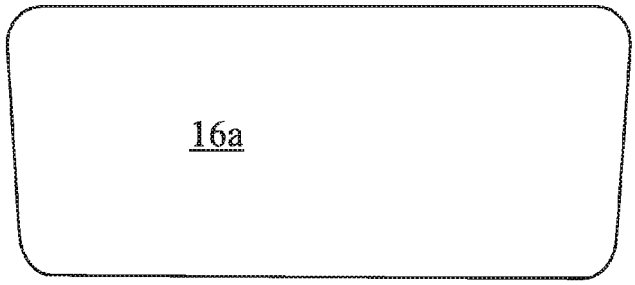
FIG. 4B is a front view of the head rest cover of the head rest and massager according to the present invention.
Figure 4C:
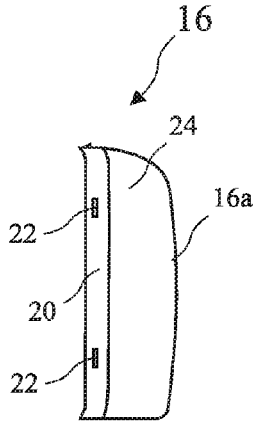
FIG. 4C is a side view of the head rest cover of the head rest and massager according to the present invention.
Figure 4D:
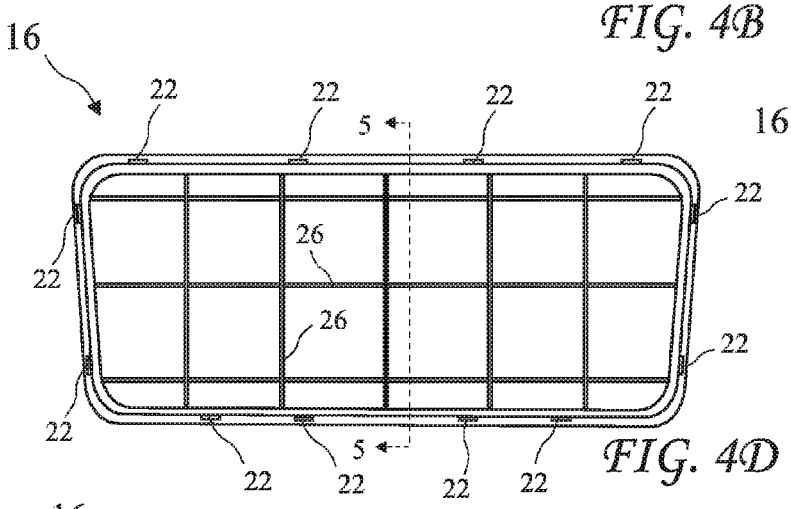
FIG. 4D is a rear view of the head rest cover of the head rest and massager according to the present invention.
Figure 5:
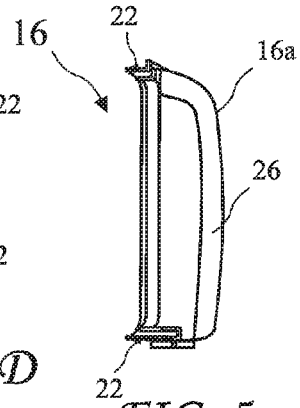
FIG. 5 is a cross-sectional view taken along line 5-5 of FIG. 4D of the head rest cover of the head rest and massager according to the present invention.
Figure 4E:
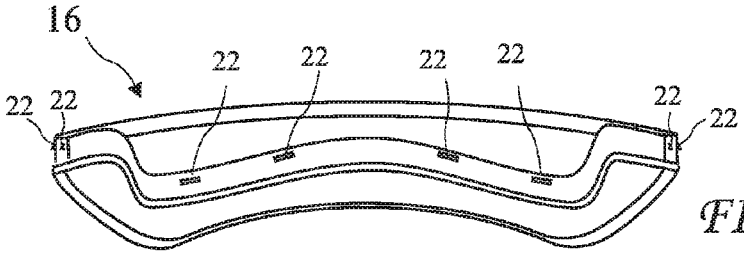
FIG. 4E is a bottom view of the head rest cover of the head rest and massager according to the present invention.

A top view of the head rest cover 16 is shown in FIG. 4A, a front view of the head rest cover 16 is shown in FIG. 4B, a side view of the head rest cover 16 is shown in FIG. 4C, a rear view of the head rest cover 16 is shown in FIG. 4D, a bottom view of the head rest cover 16 is shown in FIG. 4E, and a cross-sectional view taken along line 5-5 of FIG. 4D of the head rest cover 16 is shown in FIG. 5. The head rest cover 16 has a concave curved front 16*a* and a convex curved back 16*b*. A cover lip 20 runs continuously around the back 16*b* and includes spaced apart catches 22 for engaging corresponding notches 31 (see FIG. 6E) in the head rest support plate 14. Reinforcing members 26 form a grid inside the head rest cover 16 and comprise spaced apart vertical and horizontal flat members attached to the curved front 16*a*.

Figure 6A:
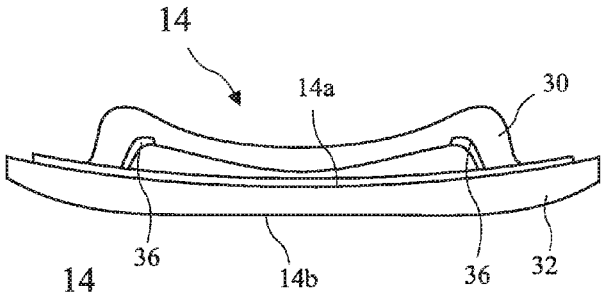
FIG. 6A is a top view of a head rest support plate of the head rest and massager according to the present invention.
Figure 6B:
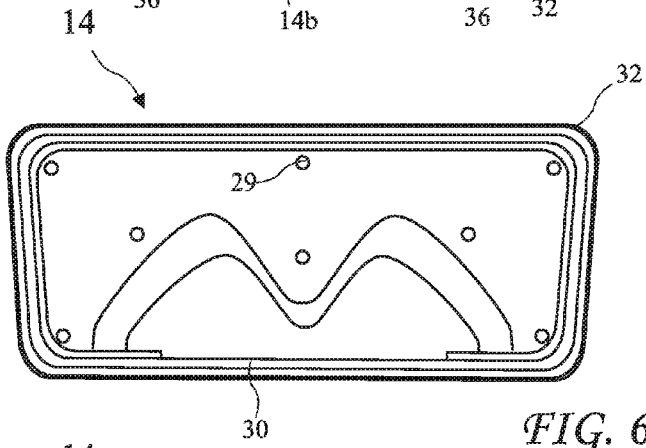
FIG. 6B is a front view of the head rest support plate of the head rest and massager according to the present invention.
Figure 6C:
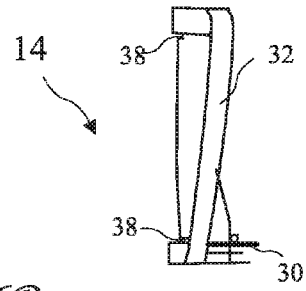
FIG. 6C is a side view of the head rest support plate of the head rest and massager according to the present invention.
Figure 6D:
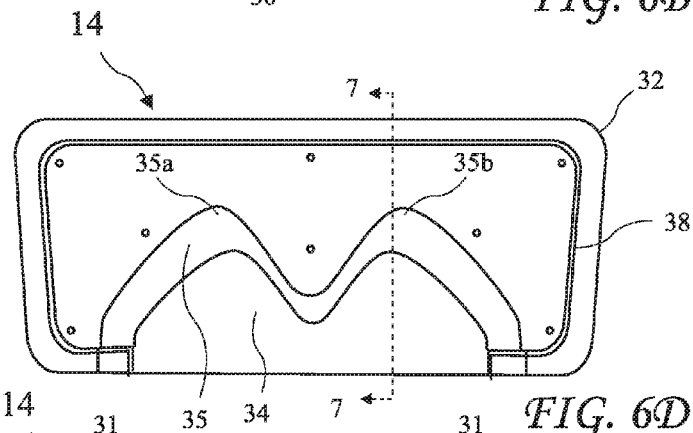
FIG. 6D is a rear view of the head rest support plate of the head rest and massager according to the present invention.
Figure 7:
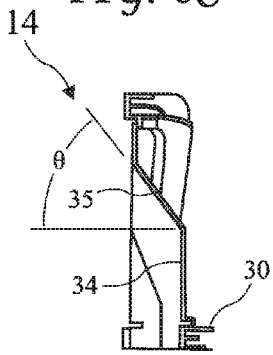
FIG. 7 is a cross-sectional view taken along line 7-7 of FIG. 6D of the head rest support plate of the head rest and massager according to the present invention.
Figure 6E:
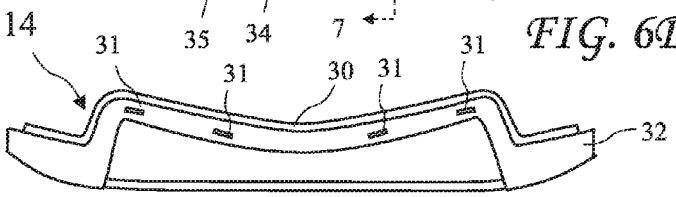
FIG. 6E is a bottom view of the head rest support plate of the head rest and massager according to the present invention.

A top view of the head rest support plate 14 is shown in FIG. 6A, a front view of the head rest support plate 14 is shown in FIG. 6B, a side view of the head rest support plate 14 is shown in FIG. 6C, a rear view of the head rest support plate 14 is shown in FIG. 6D, a bottom view of the head rest support plate 14 is shown in FIG. 6E, and a cross-sectional view taken along line 7-7 of FIG. 6D of the head rest support plate 14 is shown in FIG. 7. The head rest support plate 14 includes a front support plate face 14*a*, a rear support plate face 14*b*, and an outward facing rim 32 running continuously around the head rest support plate 14 forming an outside edge between the faces 14*a* and 14*b*. The rim 32 includes the spaced apart notches 31 for engaging the catches 22 (see FIG. 4D) to retain the head rest cover 16 on the head rest support plate 14. Some of the notches 31 are cutouts in the rim 32 as seen in FIG. 6E, and others are recesses on the interior of the rim 32 which do not extend through the rim 32.

The head rest support plate 14 further includes a sloping roof surface (or roof portion) 35 for downwardly deflecting a horizontal flow of water 52 (see FIG. 11) flowing into the head rest and massager 12 through inlets 52 in the head rest back plate 18, into a uniformly laterally distributed downward flow of water 54. The roof surface 35 vertically overlaps the water inlets 52 in the assembled head rest and massager 12 and faces down and towards head rest back plate 18. The sloping roof surface 35 is preferably sloped at an angle θ of between approximately 30 degrees and approximately 45 degrees. The roof surface 35 includes two peaks 35*a* and 35*b*, and each peak 35*a* and 35*b* laterally overlaps one of the two water inlets 52. The roof surface 35 widens downward from each peak 35*a* and 35*b* and joining between the peaks 35*a* and 35*b* to form an "M" shape. The widening roof surface forms a cavity (or gap) 56 (see FIG. 11) between the head rest back plate 18 and the head rest support plate 14 which directs the two horizontal flows of water 52 into a uniformly laterally distributed downward flow of water 54. A vertical wall surface 34 extends downward from a lower edge of the roof surface 35 of the head rest support plate 14 and faces the head rest back plate 18 in the assembled head rest and massager 12 forming a side of the cavity 56.

A groove 38 spaced apart and inside the rim 32 extending into the rear support plate face 14*b* runs across the top, down the sides and into bottom edges of the sloping roof surface 35. The groove 38 receives a forward extending portion of an edge 48 (see FIGS. 8A-8E) of the head rest backing plate 18. The edge 48 includes end portions 48*a* which reach forward along outside edges of the floor surface 42 of the head rest backing plate 18. The head rest support plate 14 also includes cylindrical hollow bosses on the front support plate face 14*a* for receiving screws to attach the head rest backing plate 18 to the head rest support plate 14. The head rest support plate 14 further includes an edge 30 on the front support plate face 14*a* spaced above a bottom portion of the rim 32 along the bottom of the head rest support plate 14 and following the contour of the bottom portion of the rim 32.

Figure 8A:
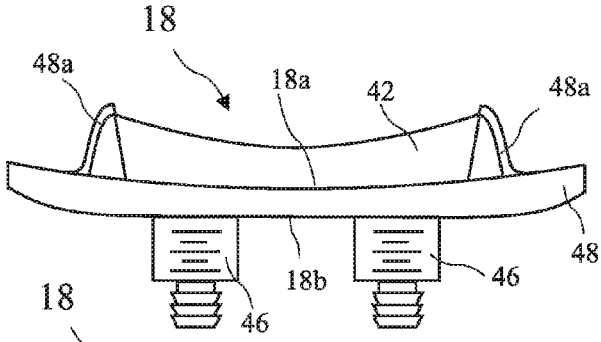
FIG. 8A is a top view of a head rest back plate of the head rest and massager according to the present invention.
Figure 8B:
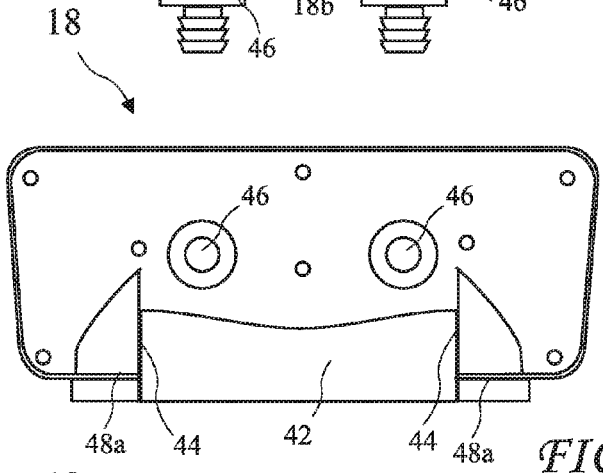
FIG. 8B is a front view of the head rest back plate of the head rest and massager according to the present invention.
Figure 8C:
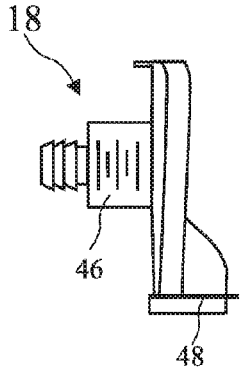
FIG. 8C is a side view of the head rest back plate of the head rest and massager according to the present invention.
Figure 8D:
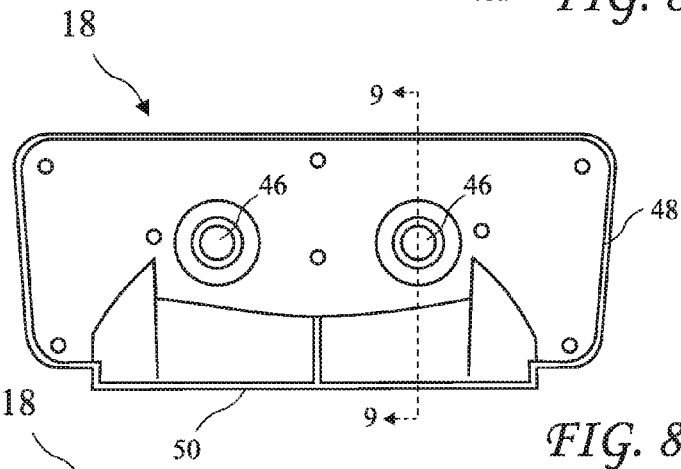
FIG. 8D is a rear view of the head rest back plate of the head rest and massager according to the present invention.
Figure 9:
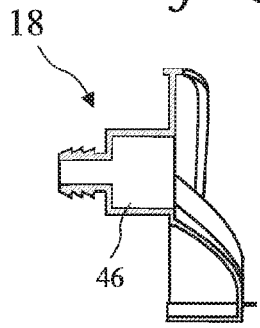
FIG. 9 is a cross-sectional view taken along line 9-9 of FIG. 8D of the head rest back plate of the head rest and massager according to the present invention.
Figure 8E:
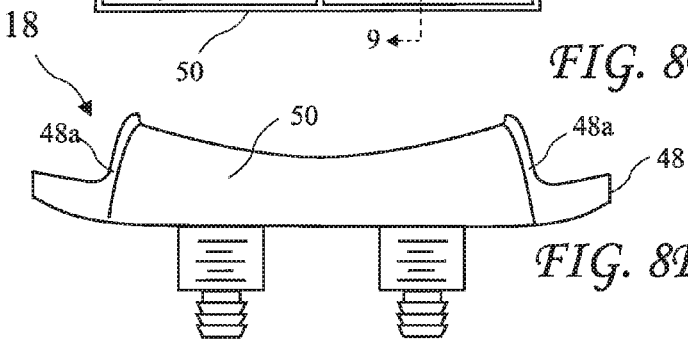
FIG. 8E is a bottom view of the head rest back plate of the head rest and massager according to the present invention.

A top view of the head rest back plate 18 is shown in FIG. 8A, a front view of the head rest back plate 18 is shown in FIG. 8B, a side view of the head rest back plate 18 is shown in FIG. 8C, a rear view of the head rest back plate 18 is shown in FIG. 8D, a bottom view of the head rest back plate 18 is shown in FIG. 8E, and a cross-sectional view taken along line 9-9 of FIG. 8D of the head rest back plate 18 is shown in FIG. 9. The head rest back plate 18 has a back plate rear face 18*b* for residing against the spa wall and a back plate front face 18*a* opposite the back plate rear face. The two water inlets 46 extend from the back plate rear face 18*b* and include larger diameter threaded portions adjacent to the back plate rear face 18*b* and barbed hose connection portions behind the threaded portions. The two water inlets 46 carry the two horizontal flows of water 52 into the head rest and massager 12. The head rest back plate 18 includes the floor surface (or portion) 42 extending forward (or away from the spa wall) residing below the water inlets 46 and facing upward and forward and extending laterally to at least the lateral separation of the two inlets 46.

A bottom view of the head rest and massager 12 showing a laterally slotted curved water outlet 54 according to the present invention is shown in FIG. 10A, a front view of the head rest and massager 12 showing a sheet of water 58 directed downward from the laterally slotted curved water outlet 54 is shown in FIG. 10B, and a cross-sectional view of the head rest and massager 12 showing the horizontal flow of water 52 into the head rest and massager 12 and the sheet of water 58 directed downward from the head rest and massagers 2 is shown in FIG. 11. The horizontal flows of water 52 enter the head rest and massager 12 through the two laterally spaced apart inlets 46 and enter a cavity (or gap or manifold) 56 formed between the rear rest support plate 14 and the head rest back plate 18. Specifically, the roof surface 35, the wall 34 (see FIG. 7), and the floor surface 42 define or form the cavity 56 (see FIG. 8B). The roof surface 35 redirects the horizontal flows of water 52 into a downward flow and the peaks of the roof 35*a* and 35*b* distribute the two horizontal flows into a uniform downward flow leaving the laterally slotted curved water outlet 54. The laterally slotted curved water outlet 54 is curved away from the spa wall at ends of the laterally slotted curved water outlet 54 to distribute the sheet of water 58 across a user's neck and shoulders.

While the invention herein disclosed has been described by means of specific embodiments and applications thereof, numerous modifications and variations could be made thereto by those skilled in the art without departing from the scope of the invention set forth in the claims.

I claim:

1. A spa wall mounted head rest and neck and shoulder massager comprising:

a headrest back plate residing in a corner of a spa and against the spa wall and including two laterally spaced apart water inlets for receiving two horizontal flows of water;

a headrest support plate residing over the back plate;

a curved and slanted roof portion of the support plate the roof portion vertically overlapping with the water inlets and sloping down and away from the water inlets and including two peaks, each peak laterally overlapping one of the two water inlets, the roof portion widening downward from each peak and joining between the peaks for directing the horizontal flows of water into a uniformly laterally distributed downward flow of water;

a vertical wall portion of the support plate extending downward from a lower edge of the roof portion of the support plate;

a cavity residing between the back plate and the support plate, the roof portion of the support plate forming a ceiling of the cavity and the wall portion of the support plate forming a wall of the cavity, the cavity in fluid communication with the water inlets and carrying the downward flow of water;

a downward facing laterally slotted water outlet residing between the back plate and the support plate in fluid communication with the cavity for receiving the downward flow of water and disbursing the downward flow of water as a sheet of water directed downward against a user; and a head rest cover residing over the support plate.

2. The head rest of claim 1, wherein the slotted water outlet is curved away from the spa wall at ends of the slot.

3. A spa wall mounted head rest and neck and shoulder massager comprising:

a headrest back plate residing in a corner of a spa and having a back plate rear face residing against the spa wall and a back plate front face opposite the back plate rear face, the back plate including two laterally spaced apart water inlets on the back plate rear face for receiving two horizontal flows of water;

a slanted floor surface of the back plate front face residing below the water inlets and facing upward and forward and extending laterally to at least the lateral separation of the two inlets;

a headrest support plate residing against the back plate front face;

a curved and slanted roof surface of the support plate, the roof surface vertically overlapping with the water inlets and facing down and towards the water inlets and including two peaks, each peak laterally overlapping one of the two water inlets, the roof surface widening downward from each peak and joining between the peaks for directing the horizontal flows of water into a uniformly laterally distributed downward flow of water;

a vertical wall surface of the support plate extending downward from a lower edge of the roof surface of the support plate and facing the back plate;

a gap between the floor surface of the back plate and the roof surface and the wall surface of the support plate, the gap in fluid communication with the water inlets and carrying the downward flow of water;

a downward facing laterally slotted water outlet residing between the back plate and the support plate and curved away from the spa wall at ends of the slotted water outlet and in fluid communication with the gap for receiving the downward flow of water and disbursing the downward flow of water as a sheet of water directed downward against a user's neck and shoulders; and a head rest cover residing over the support plate.

4. A spa wall mounted head rest and neck and shoulder massager comprising:

a headrest back plate residing against the spa wall and including at least one water inlet for receiving a horizontal flow of water;

a slanted floor surface of the back plate front face residing below the water inlet and facing upward and forward;

a headrest support plate residing over the back plate front face;

a curved and slanted roof portion of the support plate, the roof portion vertically overlapping with the water inlet and sloping down and away from the water inlet and including at least one peak, the peak aligned with the water inlet, the roof portion widening downward from the peak for directing the horizontal flow of water into a uniformly laterally distributed downward flow of water;

a vertical wall portion of the support plate extending downward from a lower edge of the roof portion of the support plate;

a cavity residing between the back plate and the support plate, the roof portion of the support plate forming a ceiling of the cavity and the wall portion of the support plate forming a wall of the cavity, the cavity in fluid communication with the water inlet and carrying the downward flow of water;

a downward facing laterally slotted water outlet residing between the back plate and the support plate in fluid communication with the cavity for receiving the downward flow of water and disbursing the downward flow of water as a sheet of water directed downward against a user; and a head rest cover residing over the support plate.

5. The spa wall mounted head rest and neck and shoulder massager of claim 4, wherein the backing plate fits into a corner of the spa wall.

6. The spa wall mounted head rest and neck and shoulder massager of claim 4, wherein the back plate includes two laterally spaced apart water inlets on the back plate rear face for receiving two horizontal flows of water through the spa wall.

7. The spa wall mounted head rest and neck and shoulder massager of claim 6, wherein the slanted floor surface of the back plate front face extends laterally to at least the lateral separation of the two inlets.

8. The spa wall mounted head rest and neck and shoulder massager of claim 7, wherein the roof portion of the support plate vertically overlaps with the two water inlets and slopes down and away from the two water inlets and including two peaks, each of the two peaks aligned with one of the two water inlets, the roof portion widening downward from each of the two peaks for directing the horizontal flows of water into the uniformly laterally distributed downward flow of the water.

* * * * *